US005462257A

United States Patent [19]

Trowbridge

[11] Patent Number: 5,462,257

[45] Date of Patent: Oct. 31, 1995

[54] JACK STAND

[76] Inventor: Larry G. Trowbridge, 632 Monroe Jackson Rd., Meigs, Ga. 31765

[21] Appl. No.: 309,080

[22] Filed: Sep. 20, 1994

[51] Int. Cl.[6] ..... B66F 5/00

[52] U.S. Cl. ..... 254/8 B; 254/1; 254/133 R; 254/DIG. 1

[58] Field of Search ..... 254/131, 133 R, 254/134, 1, 8 B, DIG. 1; 180/180, 192, 115

[56] References Cited

U.S. PATENT DOCUMENTS

| | | | |
|---|---|---|---|
| 137,602 | 4/1873 | Edwards | 108/115 |
| 2,409,495 | 10/1946 | Kelley | 108/115 |
| 2,751,191 | 6/1956 | Schroeder . | |
| 2,814,394 | 11/1957 | Witcher | 254/8 B |
| 3,829,063 | 8/1974 | Holzworth . | |
| 3,834,669 | 9/1974 | Reid | 254/133 |
| 3,902,699 | 9/1975 | Brackett . | |
| 3,937,443 | 2/1976 | Durgan . | |
| 4,336,921 | 6/1982 | Wienhold | 254/1 |
| 4,479,634 | 10/1984 | Blatz | 254/133 R |
| 5,033,717 | 7/1991 | Symon . | |

*Primary Examiner*—Robert C. Watson
*Attorney, Agent, or Firm*—Jones & Askew

[57] ABSTRACT

A jack stand for supporting a lifting jack beneath a work piece to be raised or lowered. The jack stand includes a base movable along a floor surface, and a jack support platform supported in elevated relation above the base. Struts are pivotably connected to the jack support platform and extend downwardly to engage the base, transferring a portion of the weight of the jack to the base. Those support struts are displaceable when the base is positioned beneath an interfering machine structure, allowing that structure to fit within the open space between the base and the jack support platform, so that the jack stand can fit beneath a work piece notwithstanding the interfering structure.

1 Claim, 3 Drawing Sheets

JACK STAND

FIELD OF THE INVENTION

This invention relates in general to supporting apparatus such as jacks and the like, and relates in particular to a stand for supporting a jack in relation to a workpiece.

BACKGROUND OF THE INVENTION

Machines of various kinds often have heavy components that require removal or servicing from time to time. Jacks or similar supporting devices are commonly used for that purpose. The jack may be either a general-purpose hydraulic or mechanical jack of the kind used in most shops or service facilities, or alternatively may be specially designed and built for the particular application. In either case, the jack first is positioned beneath the component to be lifted or supported, and the jack then is raised to engage that component.

It is known to equip jack stands or purpose-built jacks with wheels or rollers, permitting easy placement of a jack beneath a workpiece or machine. Examples of such prior art are seen in U.S. Pat. Nos. 2,751,191 disclosing a mobile jack stand; and in 3,829,063 disclosing an elevated platform installed on a handtruck. Those jacks and jacks stands are suitable for applications such as truck or tractor repair, where no existing structure blocks placing the jack beneath a selected component to be supported by the jack. However, such interfering structure does exist in certain other environments. For example, some industrial machines contain drive gears that are accessible only from the underside of the machine, and that must be removed or adjusted for a proper synchronism from time to time. These industrial machines are supported on the shop floor by posts extending downwardly from the machine frame to mounting pads that engage the floor, and adjacent posts are interconnected by horizontal bracing to provide a rigid support for the operating parts of the machine. This support structure for the machine, and in particular the braces that interconnect the posts and provide structural rigidity for the machine supports, make it impossible to place a conventional jack beneath the machine to engage a gear or other machine component accessible only from the underside of the machine. Custom designing a jack or other tool to fit a particular machine of that kind is prohibitively expensive, given the relatively small market for such custom-designed equipment compared to the relatively broad market for conventional general-purpose jacks. Consequently, removing or adjusting gears or other machine parts in such applications usually is done entirely with manual labor, incurring the risk that a mechanic may be injured by an unsupported machine part that slips while being positioned beneath a machine.

SUMMARY OF THE INVENTION

Accordingly, it is an object of the present invention to provide an improved stand for supporting a jack.

It is another object of the present invention to provide a jack stand that can be used with a conventional jack.

It is a further object of the present invention to provide a jack stand that allows positioning a jack beneath a load notwithstanding the presence of interfering structure.

It is a further object of the present invention to provide a jack stand for receiving a conventional jack and positioning that jack against a workpiece above interfering structure.

Stated in general terms, the present invention is a jack stand having a base supportable on a floor and configured for placing and removing the base beneath a machine part that otherwise would block placement of a conventional jack. The jack stand further includes a support platform mounted above the base, hereby providing a space between the base and the jack support platform. This space is configured to receive the frame structure or other machine part that otherwise would interfere with placement of a conventional jack on the floor beneath the machine element to be engaged by the jack. The jack support platform itself is configured to received a conventional jack, which may optionally be bolted or otherwise affixed to the support platform.

In addition to the support maintaining the jack support platform above the base, the jack stand includes at least one other element extending between the support platform and the base to transfer the weight of the jack, including any load supported by the jack, from the jack support platform to the base. This other support element normally extends downwardly from the jack support platform in load transfer contact with the base. However, the support element is selectively displaceable from that load transfer position while the base of the jack stand is being placed beneath the interfering part of the machine. Once the jack stand is so placed, with the interfering machine part now located in the space defined between the base and the jack support platform, the additional support element is returned to the load transfer relation between the jack support platform and the base. The jack itself, which now is supported by the platform above the interfering machine part, may now be operated to engage a gear or other machine element, constituting a workpiece for removal from or installation to the machine.

Stated in somewhat greater detail, the jack support platform is maintained above the base by a support member located at one end of the base and extending upwardly to a corresponding end of the jack support platform. The selectively displaceable support element is located in lateral spaced relation to the support member, and comprises one or more struts extending between the base and the jack support platform. This strut or struts are displaceable with regard either to the base or the jack support platform, allowing the interfering machine part to enter the space between the base and jack support platform when the jack stand is being positioned beneath the workpiece. The strut or struts thereafter return to weight transfer relation between the jack support platform and the base, so that a portion of the weight of the jack and the workpiece being lifted or supported by the jack is transferred to the base through the struts.

Stated in further detail, the struts are pivotably connected to the jack support platform so as to be displaceable as the jack support platform is being placed above the interfering machine part. Once the jack support platform is in place, those struts pivot downwardly to engage the underlying base. The base itself may comprise a pair of elongated rails mounted and parallel in a mutually spaced-apart relation, with each strut being laterally aligned with a corresponding one of those base rails. The base rails preferably am equipped with wheels or rollers to allow easy positioning of the jack stand relative to a workpiece.

Other objects and advantages of the present invention will become more readily apparent from the following description of a preferred embodiment.

DETAILED DESCRIPTION OF THE INVENTION

Figure 1:
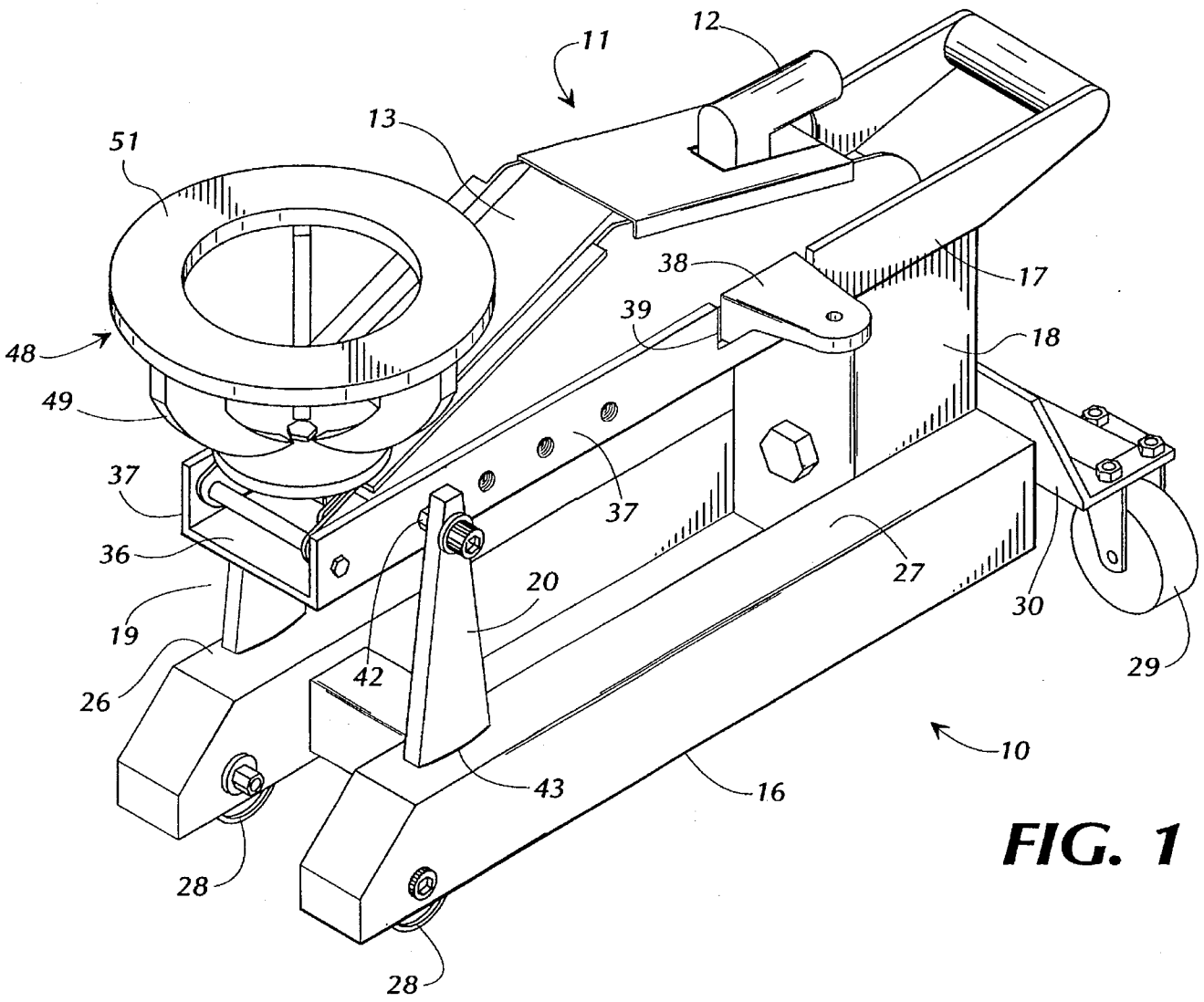
FIG. 1 is a pictorial view showing a jack stand according to a preferred embodiment of the present invention.

Turning first to FIG. 1, there is shown generally at 10 a jack stand according to a preferred embodiment of the present invention. This jack stand is shown supporting a jack 11, depicted as conventional mechanic's jack having a handle socket 12 at one end and a lift platform 13 at the other end of the jack. The jack stand 10 includes a base 16 and a jack support platform 17 mounted in elevated relation above the base. A support post 18 is mounted at one end of the base 11 and extends upright from the base to engage the jack support platform 17 near one end of that platform. The base 16, the jack support platform 17, and the support post 18 extending between those two elements, preferably are rigidly interconnected with each other so as to maintain the jack support platform elevated above the base and substantially parallel to the base. An open space 19 thus extends between the base 16 and the jack support platform 17, that open space being bounded at one end by the support post 18 and at the other end by the displaceable struts 20 and 21 (FIG. 2), described below in greater detail.

Figure 2:
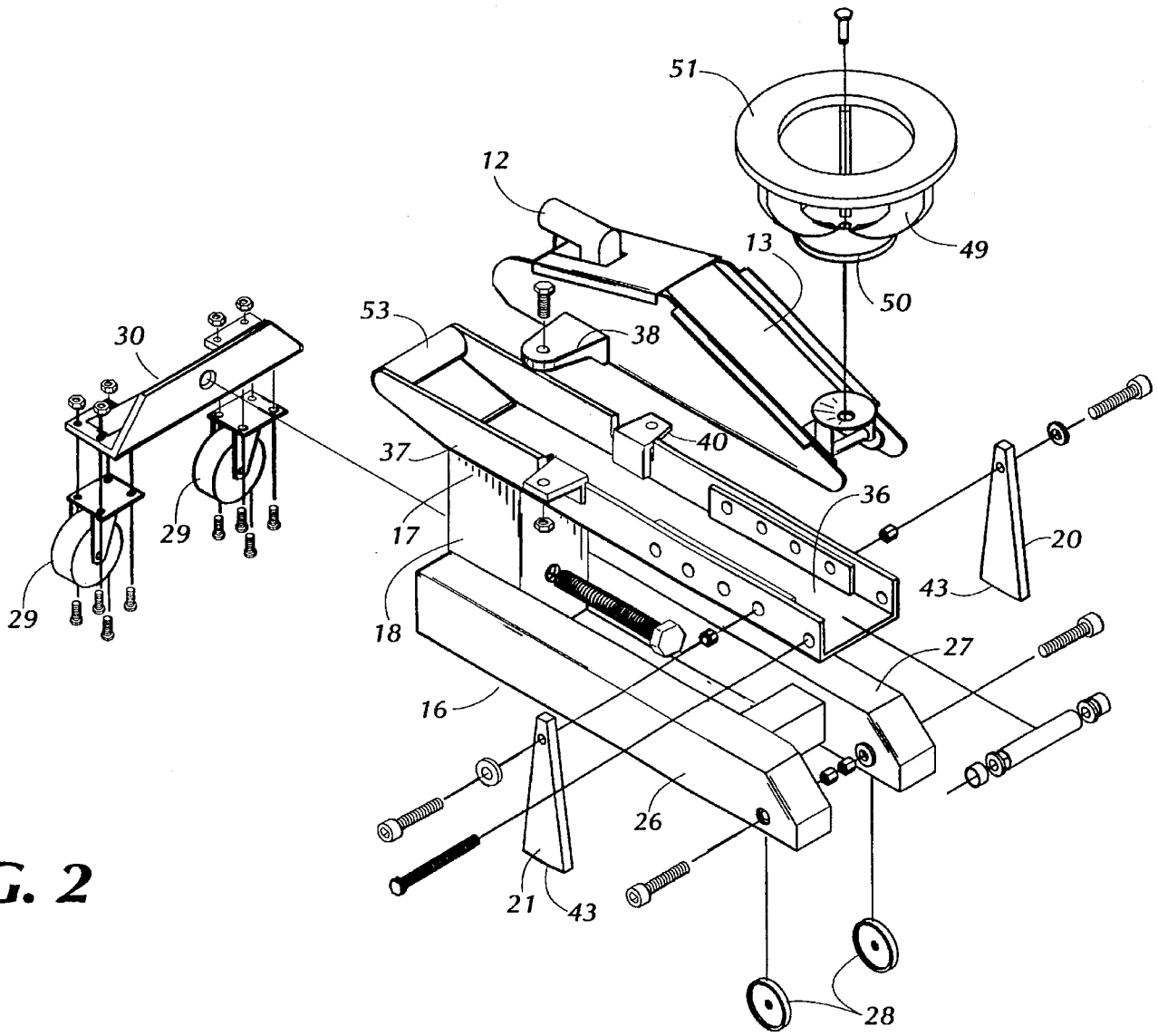
FIG. 2 is an exploded view of the jack stand as shown in FIG. 1.

The component parts of the jack stand 10 are seen in greater detail in FIG. 2. The base 19 is seen to comprise two elongated rails 26 and 27, and each rail preferably is a hollow U-shaped channel with the open side facing downwardly. A wheel 28 is mounted within a forward end of each base rail, to assist in maneuvering the jack stand along a floor or other surface. Another pair of wheels 29, preferably caster wheels for ease of positioning the jack stand, is attached to a mounting plate 30 affixed to the back end of the base rails 26 and 27. The caster wheels 29 likewise assist in maneuvering the jack stand on a floor surface.

The support post 18 is connected to the facing sides of the two rails 26 adjacent the back ends of those rails. The support tube 18 maintains the desired lateral spacing between the two base rails and also provides a rigid interconnection between those rails. The support post 18, in the preferred embodiment, is a square hollow metal tube. The top end of the support post 18 is fastened to the underside of the jack support platform 17 near the back end of that platform.

The jack support platform 17 forms an elongated tray dimensioned to receive the particular kind of jack 11 for which the jack stand 10 will be used. The jack support platform 17 includes a base 36 surrounding by raised sidewalls 37 which define the tray and help position the jack within the jack support platform. As a safety precaution, the jack 11 is attached to the jack support platform 17 by the brackets 38 attached to the jack. Those brackets are fastened to the mating brackets 40 attached to the jack support platform 17 and accommodated in the notches 39 cut into the raised sidewalls 37 of the jack support platform. The jack thus is readily removable from the jack stand 10 by unfastening the brackets 38.

The struts 20 and 21 are pivotably attached to the sidewalls 37 at opposite sides of the jack support platform, at a position longitudinally spaced apart from the support post 18 extending between that platform and the base 16. Each strut 20, 21, in the disclosed embodiment, comprises an elongate metal plate with a pivotable connection 42 joining the upper end of the strut to the sidewall 37 of the jack support platform. The end 43 of the strut remote from the pivotable connection 42 contacts the top surface of a corresponding base rail 26 near the front end of that rail. However, those remote ends in the preferred embodiment are not connected to the base rails. Instead, the remote end 43 of each strut preferably is arcuate in shape, and may comprise a radius taken with respect to the pivotable connection 42 at the other end of the strut. The remote end 43 of each strut 20, 21 normally contacts the upper end of the corresponding base rail 26 inwardly of the front wheel 28 attached to the base rail, so that the weight of the jack 11 carried by the jack support platform cannot exert a tipping moment tending to upset the jack stand 10 around the front wheels of the jack stand.

A support cradle 48 is attached to the lifting platform 13 of the jack 11. This lifting cradle in the preferred embodiment has a plurality of supports 49 extending upwardly from a base plate 50 to join the underside of a load support plate 51. The load support plate 51, which is of larger diameter than the base plate 50 joining the support cradle 48 to the lifting platform of the jack, has a substantially flat upper surface of diameter configured to engage a ring gear 52 (FIGS. 3 and 4) which constitutes the particular workpiece with which the disclosed embodiment of the jack stand is intended for use. Those skilled in the art will understand that the load support plate can be adapted to engage or received workpieces of differing sizes and configurations, when adapting the present invention for other applications.

Figure 3:
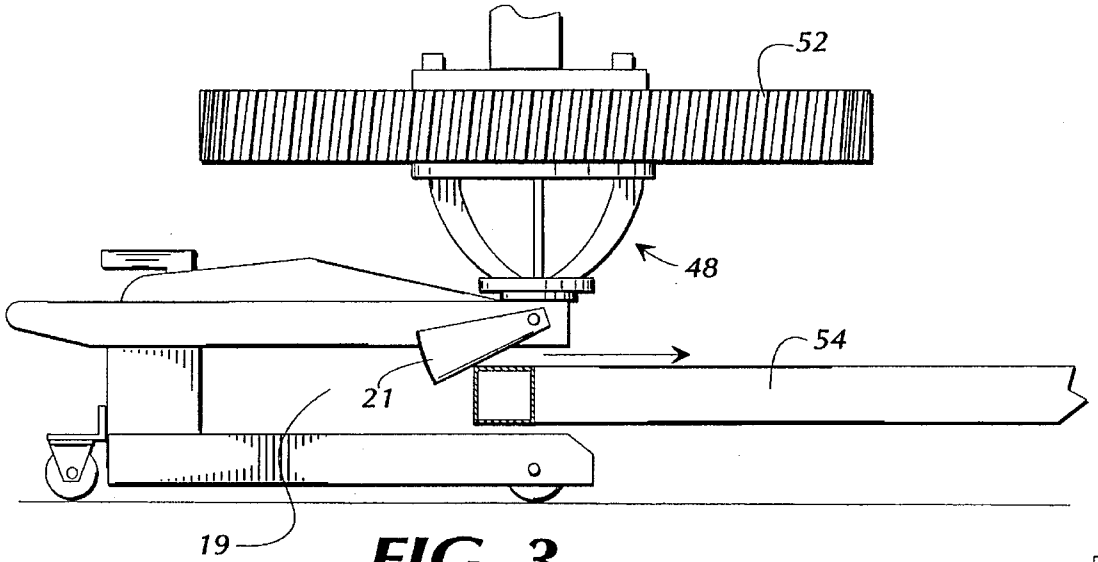
FIG. 3 is a side elevation view of the jack stand shown in FIG. 1, showing that jack stand supporting a workpiece and being placed in a lifting position relative to an interfering machine part.
Figure 4:
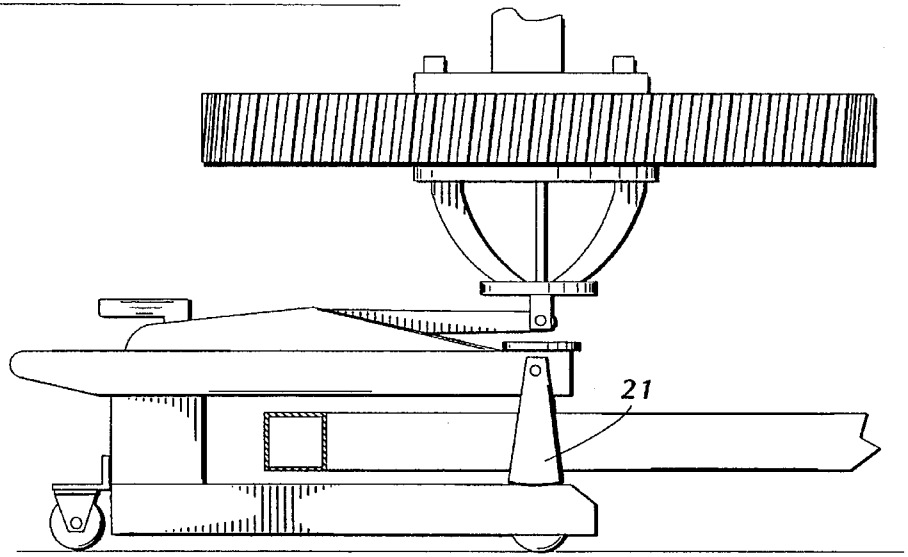
FIG. 4 is a view as in FIG. 3, showing the jack stand in lifting position.

The operation of the jack stand 10 is now described. Assuming the need to remove a heavy gear 52 or other workpiece from a machine, the jack 11 is positioned on the jack support platform 17 and optionally secured in place by means of the brackets 38. The jack stand 10 next is manipulated to position the jack stand, and in particular the support cradle 48 attached to the jack, beneath the workpiece to be lifted. The jack stand may be manipulated by a conventional handle attached to the jack itself, or by grasping the hand grip formed at the back end of the jack support platform. Assuming that the space beneath the work piece contains some interfering structure such as the brace 54, FIGS. 3 and 4, the base rails 26 of the jack stand must be configured to fit beneath those braces as the jack stand is positioned to place the support cradle 48 beneath a work piece located generally above the interfering machine part. As the jack stand is advanced to place the jack beneath the work piece, the interfering machine part 54 contacts the forward sides of the struts 20, 21 as shown in FIG. 3, pivotably displacing those struts around the pivotable connection 42 of each strut to the jack support platform 17. The interfering braces 54 thus move into the open space 19 between the base and the jack support platform, allowing the struts 20 and 21 to pivot downwardly to the substantially vertical position shown in FIG. 4 with the remote ends 43 of the struts confronting the upper surfaces of the base rails 26.

The operator of the jack stand now raises the lifting platform 13 of the jack, moving the support cradle upwardly to engage the work piece. Once the weight of the work piece is fully supported on the cradle, that work piece can be connected to its shaft or other complementary machine part, after which the jack 11 can be lowered to withdraw the support cradle 48 from the now-connected work piece. The jack stand 10 may now be withdrawn from under the machine, to remove the jack. As the jack stand is withdrawn, the braces 54 or other interfering machine part again pivotably displaces the struts 20, 21 as the interfering machine parts move out from the space 19.

It will now be understood that the struts 20 and 21 provide substantial load-bearing support for the jack stand 17, the jack 11 supported on that stand, and a work piece carried by the jack. With the struts in their downward position contacting the base rails as shown in FIG. 1, a portion of that combined weight is transmitted through the struts to the base 16 of the jack stand. This support may be particularly important when the jack stand is used to install a work piece into the machine, as the jack may be exerting an upward force on the work piece to help position the work piece with respect to mating components of the machine. Although the struts are moved out of load-bearing relation during the short time that the jack stand is being moved into or out of position relative to the work piece in the machine, the rigid connection provided between the base and the jack support platform by the support post 18 is sufficient to maintain those elements in place during that relatively brief time.

It should be understood that the foregoing relates only to a preferred embodiment of the present invention, and that numerous changes and modifications therein may be made without departing from the spirit and scope of the present invention as defined in the following claims.

What is claimed is:

1. A stand for supporting a jack in predetermined relation to an element of a machine disposed on a floor and having a machine part positioned between the floor and the machine element so as to block access to the element by a jack placed on the floor, the stand comprising:

a pair of elongated base rails spaced apart from each other and interconnected at one end by a spacer member;

at least one wheel associated with each base rail so as to support the base rail for selective movement on the floor;

an upright support member mounted at the one end of the base rails and extending upwardly to an upper end a predetermined distance above the rails;

an elongated support platform attached to the upper end of the support member so that the support member is maintained above the base to define a space sufficient to accommodate the machine part without interference from the support member when the base is placed in a predetermined position beneath the machine part;

the support platform being configured to receive a jack in predetermined relation to the machine element when the base is so positioned;

a pair of struts pivotably connected to the support platform in lateral spaced apart relation to the upright support member;

the struts being spaced apart from each other so that each strut overlies one of the base rails;

the struts extending downwardly from the support platform to engage the base rails so that the struts can transfer part of the weight of the jack, and of a machine element supported by the jack, to the base rails; and the pivotable connection permitting displacement of the struts so that the blocking machine part can enter the space between the base rails and the jack support platform and the struts thereafter can return to the weight transfer relation with the base rails.

* * * * *